United States Patent [19]

Goodwin

[11] 4,073,026

[45] Feb. 14, 1978

[54] LANCE TIP CONSTRUCTION

[75] Inventor: Robert J. Goodwin, Hendersonville, N.C.

[73] Assignee: C. H. Heist Corporation, Clearwater, Fla.

[21] Appl. No.: 703,790

[22] Filed: July 9, 1976

[51] Int. Cl.[2] ..... B08B 9/02

[52] U.S. Cl. ..... 15/104.1 R

[58] Field of Search ..... 15/104.09, 104.1 R, 15/104.11, 104.14; 29/81 J

[56] References Cited

U.S. PATENT DOCUMENTS

| | | | |
|---|---|---|---|
| 1,161,122 | 11/1915 | Froussard | 15/104.1 R |
| 1,193,361 | 8/1916 | Crepeau | 15/104.09 |
| 2,313,042 | 3/1943 | Bay | 15/104.1 R |
| 2,411,209 | 11/1946 | Hall et al. | 15/104.09 |

FOREIGN PATENT DOCUMENTS

| | | | |
|---|---|---|---|
| 286,987 | 3/1928 | United Kingdom | 15/104.1 R |

*Primary Examiner*—Edward L. Roberts
*Attorney, Agent, or Firm*—Joseph P. Gastel

[57] ABSTRACT

A tube cleaning lance tip construction including a body portion, a first bore extending longitudinally of the body portion, a plurality of second bores extending between the first bore and the outer surface of the body portion for causing liquid to be ejected with a net lateral force component to bias the body portion against the inside of the tube in which the lance tip is located, and first and second rows of axially spaced blades on the opposite side of the body portion from the second bores, said blades having axial and radial cutting edges for removing incrustations from the tube as the lance tip rotates and advances axially through the tube.

18 Claims, 11 Drawing Figures

Fig. 4.
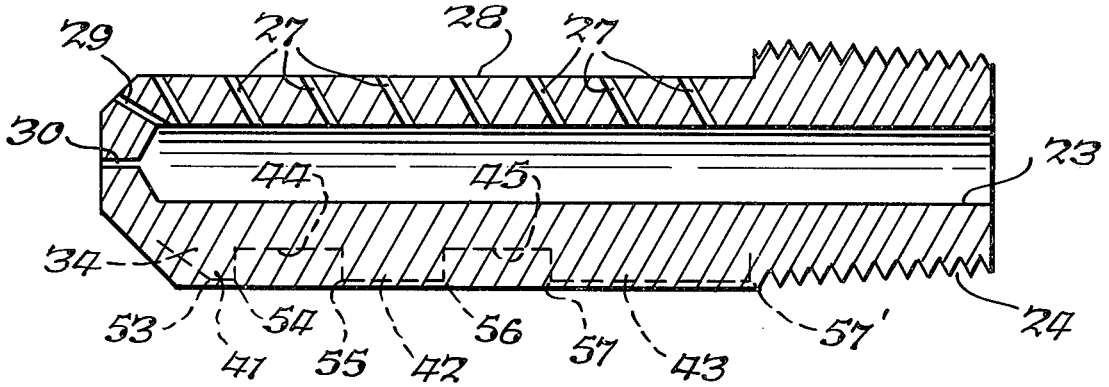
Fig. 5.
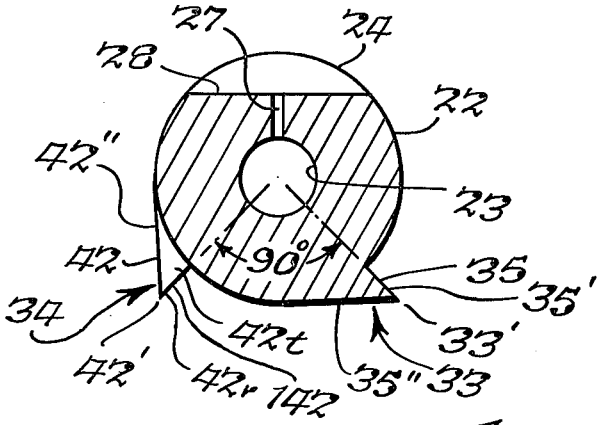
Fig. 6.
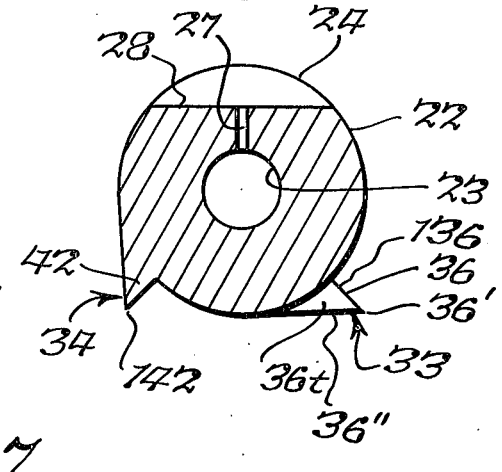
Fig. 7.
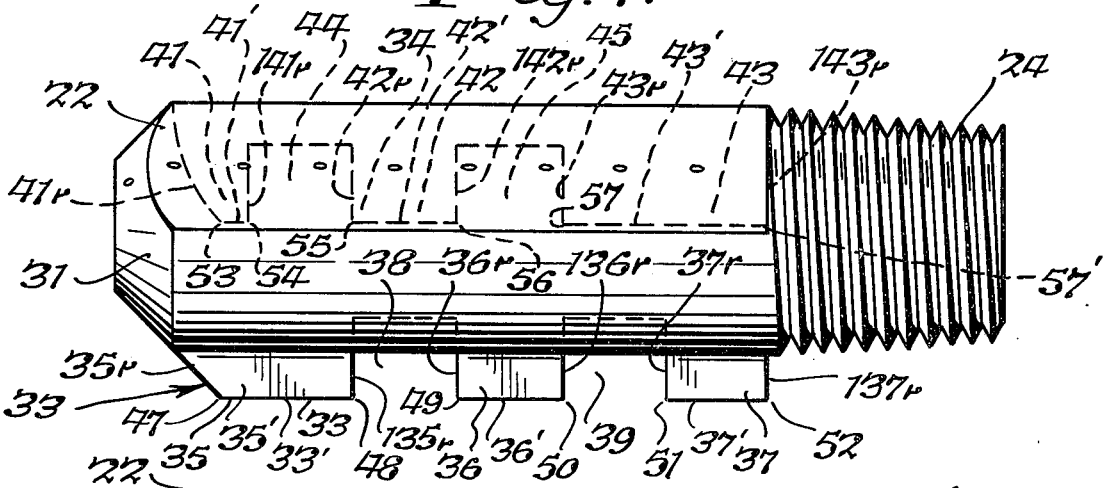
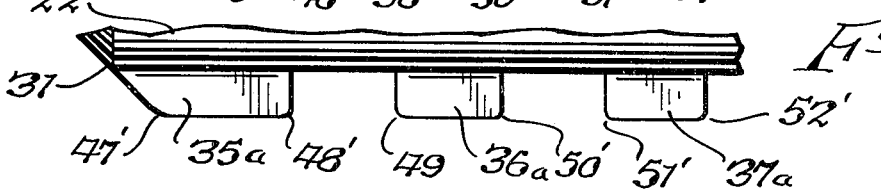
Fig. 10.

LANCE TIP CONSTRUCTION

The present invention relates to an improved lance tip construction for use in cleaning incrustations from the insides of tubes, such as those used in heat exchangers, process equipment and pipes of various sorts.

The present invention is a modification of the lance tip construction disclosed in copending U.S. application of Robert J. Goodwin, Ser. No. 611,072, filed Sept. 8, 1975, now U.S. Pat. No. 4,011,625.

By way of background, in many applications the tubes in heat exchangers, process equipment, and various pipes build up foreign deposits or incrustations during normal use. These deposits may comprise compounds which include carbon, silicon and calcium as constituents and/or organic compounds depending on the nature of the fluids flowing through the tubes. In the past, the removal of such deposits was difficult, relatively inefficient and costly. Various methods which were utilized included high pressure water cleaning, drilling and sandblasting. However, the high pressure water cleaning heretofore used could not remove the more tenacious deposits. The drilling and sandblasting, in addition to being slow and extremely costly processes, many times injured inside surfaces of the tubes. In addition, other lance tips used in the past did not have the combination of required blade configuration and capacity for lateral thrust to force blades on the tips into good incrustation-removing engagement with the inside of the tubes. Such prior art lance tips are shown in U.S. Pat. Nos. 647,132, 1,193,361, 1,355,726, 2,313,042, 2,411,209 and 3,226,258.

In accordance with the present invention, an improved lance tip construction is provided which possesses jet-producing bore means on one side of the body portion of the lance tip to cause liquid to be ejected with a net lateral force component to bias the body portion toward the inside of the tube, and a plurality of axially extending blade means with axial spaces therebetween on the opposite side of said body portion from the bore means for engaging the inside of the tube while the lance tip rotates and is advanced axially through the tube. The existence of the plurality of blade means with axial spaces therebetween provides a relatively high unit pressure on the incrustations and further provides both a relatively large number of axial cutting edges, radial cutting edges and corners on the blade means which attack the incrustations in a highly efficient manner.

The various aspects of the present invention will be more fully understood when the following portions of the specification are read in conjunction with the accompanying drawings wherein:

FIG. 1*a* is a fragmentary side elevational view partially broken away showing the improved lance tip of the present invention mounted on a lance within a tube which is being cleaned;

FIG. 1*b* is a fragmentary side elevational view which is a continuation of FIG. 1*a* and shows the hydromechanical system which advances the lance axially and rotates it while supplying high pressure liquid thereto;

FIG. 4 is a cross sectional view taken substantially along line 4—4 of FIG. 2;

FIG. 5 is a cross sectional view taken substantially along line 5—5 of FIG. 3;

FIG. 6 is a cross sectional view taken substantially along line 6—6 of FIG. 3;

FIG. 7 is a view taken substantially along line 7—7 of FIG. 2 and essentially showing the relationship of the two rows of blades to each other;

FIG. 10 is a fragmentary side elevational view similar to FIG. 7 but showing a modified form of blade construction.

Figures 1A, 1B, 2, 3:
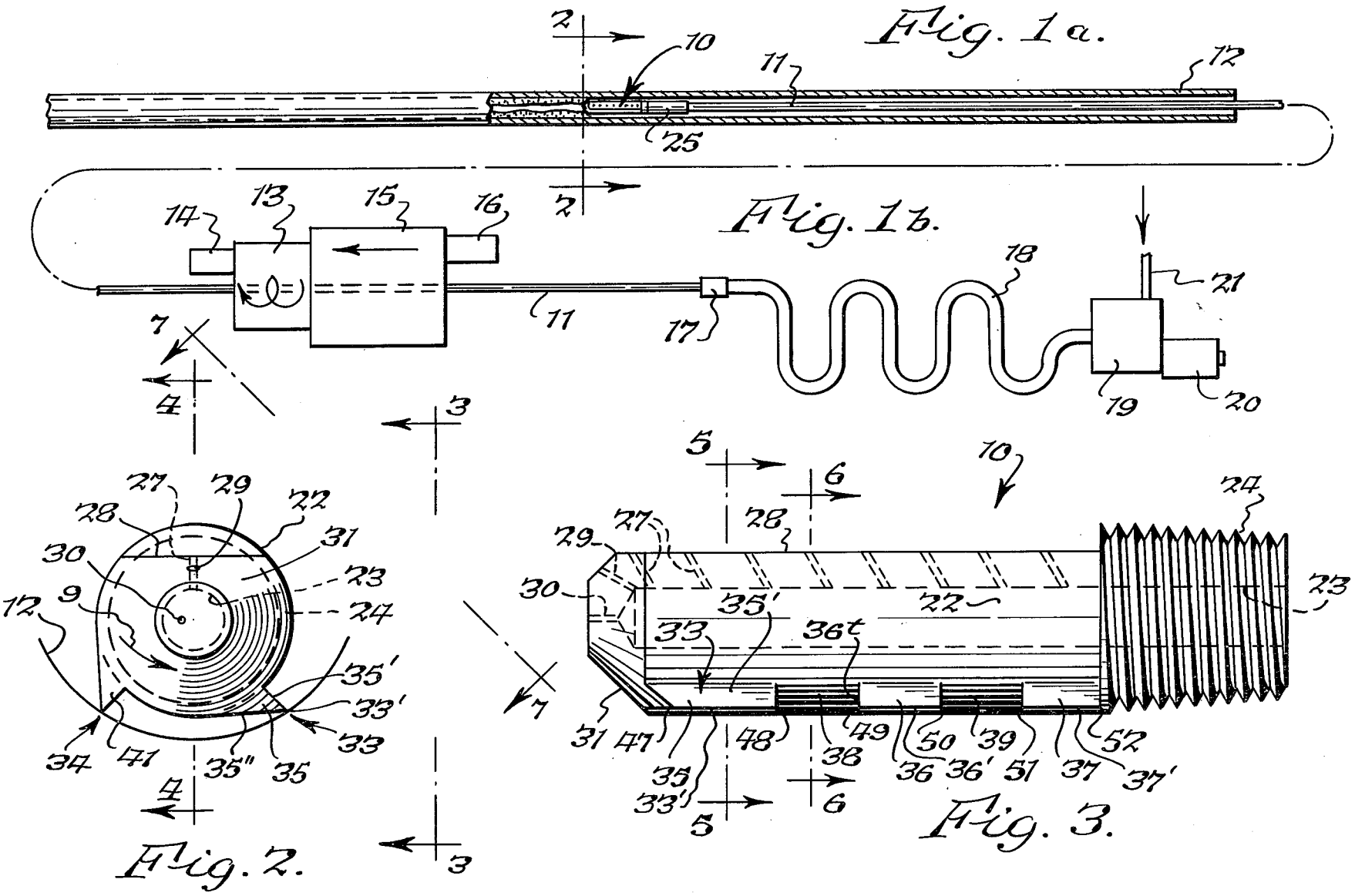
FIG. 2 is an end elevational view of the improved lance tip taken from the left of FIG. 3.
FIG. 3 is a side elevational view of the lance tip taken in the direction of line 3—3 of FIG. 2 and showing the position of the bores and certain of the blades.

Summarizing in advance, the improved lance tip 10 of the present invention is intended to be mounted on a lance 11 which is rotated and moved axially through a tube 12. In this respect a rotating mechanism 13 is driven by motor 14 and an advancing mechanism 15 is driven by motor 16. The end of lance 11 remote from lance tip 10 mounts a swivel unit 17 which is connected to hose 18. Swivel unit 17 prevents leakage between lance 11 and hose 18 and also permits lance 11 to rotate without accompanying rotation of hose 18. Hose 18 is connected to pump 19 which is driven by motor 20. Pump 19 receives water from conduit 21 and supplies it at high pressure to hose 18. Lance 11 is a hollow metal tube which is slightly greater in length than tube 12 which is to be cleaned. A common length for lance 11 is 20 to 40 feet.

The improved lance tip 10 of the present invention includes a body portion 22 having a bore 23 therein which passes through threaded connector portion 24 formed integrally with body portion 22. A connector coupling 25 is threaded onto portion 24 and onto the end of lance 11. Connector portion 24 may be of any suitable type. The front end of body portion 22 terminates with a frustoconical configuration 31 which facilitates the advance of the lance tip through the tube.

High pressure liquid which is supplied to bore 23 is forced through jet-producing bores 27 which are in communication with bore 23 and terminate at planar surface 28 formed on the outer surface of body portion 22. Bores 27 are shown at an angle of approximately 60° to the horizontal. However, they may be oriented at any other desired angle, depending on the nature of the incrustations being treated. In addition, jet-producing bores 29 and 30 are in communication with bore 23 for projecting high pressure fluid in a direction more forwardly than do bores 27 to remove deposits tending to plug the tube or inhibit passage of the tip.

In accordance with the present invention, two rows 33 and 34 of blades are located on the opposite side of body portion 22 from jet-producing bores 27. As can be seen from FIG. 2, blade rows 33 and 34 are circumferentially oriented more than 90° from bores 27, and thus are on the opposite side of the body portion from bores 27. Row 34 is parallel to and circumferentially offset from row 33. Rows 33 and 34 are parallel to the axis of lance tip 10, although they need not assume this orientation. The reactive force produced by jets of liquid emanating laterally from bores 27 on the inside of tube 12 will cause the rows of blades 33 and 34 on the opposite sides of the body portion to be biased toward the inside of tube 12 and into engagement with the incrustations therein. Row 33 consists of blades 35, 36 and 37. Blades 35 and 36 are separated by space 38, and blades 36 and 37 are separated by space 39. Row 34 consists of blades 41, 42 and 43. Blades 41 and 42 are separated by space 44, and blades 42 and 43 are separated by space 45. Each of the blades has an identical cross-sectional configuration, as can be visualized from FIGS. 2, 5 and 6.

As noted briefly above, because blade rows 33 and 34 are on the opposite side of body portion 22 from bores 27, they will be caused to be biased toward the inside of tube 12 with a relatively high force. Furthermore, since there are axial spaces between each of the blade sections in each row of blades, the unit force produced by each of the blades will be much higher than if the blades were continuous. In addition, because each row of blades contains a plurality of separated blades, there will be a greater number of incrustation-attacking corners on the blades than if each row was comprised of one continuous blade. In this respect it can be seen that blade 35 has corners 47 and 48; blade 36 has corners 49 and 50; blade 37 has corners 51 and 52; blade 41 has corners 53 and 54; blade 42 has corners 55 and 56; and blade 43 has corners 57 and 57'. Therefore, the two blades 33 and 34 have a total of twelve corners at their leading edges, whereas if the blades 33 and 34 were continuous, they would have only a total of four corners, namely, the corners at their leading and trailing ends. It can readily be seen, therefore, that when the lance tip 10 is rotating with blade rows 33 and 34 biased toward the inside of tube 12, the plurality of corners will exert a prying and breaking effect on the incrustations within the tube, and such prying and breaking effect will be much higher than can be achieved with continuous blades. The corners on the blades shown in FIGS. 2–7 are sharp, although they can be slightly rounded, as shown in FIG. 10, as discussed in detail hereafter.

It is also to be noted that the blades of row 33 project circumferentially into the spaces of between the blades of row 34, and vice versa, as can be seen from FIG. 7. More specifically, blade 35 projects circumferentially across space 44 and blade 36 projects circumferentially across space 45. In addition, blades 42 and 43 project across spaces 38 and 39, respectively. By virtue of the foregoing orientation of the blades and the spaces, complete circumferential coverage by the blades of the inside of the tube is assured, even though the lance tip may be rotating without being axially advanced. In addition, the foregoing spacing between the blades and the spaces prevents a rifling effect on the inside of the tube 12 as lance 11 is advanced.

It is to be noted that each of the blades includes a leading planar surface which is substantially radial to the body portion, such as surface 35' of blade 35 (FIGS. 2, 3, 5 and 9), and a trailing planar surface which is substantially tangential to the body portion, such as surface 35'' of blade 35. The intersection between the radial and tangential surfaces of each blade constitutes a sharp axial cutting edge. In this respect, for example, the line 33' at which planar portions 35' and 35'' intersect is the axial cutting edge of blade 35; the line 36' at which planar portions 136 and 36'' intersect is the axial cutting edge of blade 36; and the line 42' at which planar surfaces 142 and 42'' intersect is the axial cutting edge of blade 42. The other blades each have analogous structure. In this respect, the remainder of the blades 36, 41 and 43 include axial cutting edges 37', 41' and 43', respectively, which are formed in the same manner, namely, by the intersection of two planes located on the opposite sides of each blade.

Figure 8:
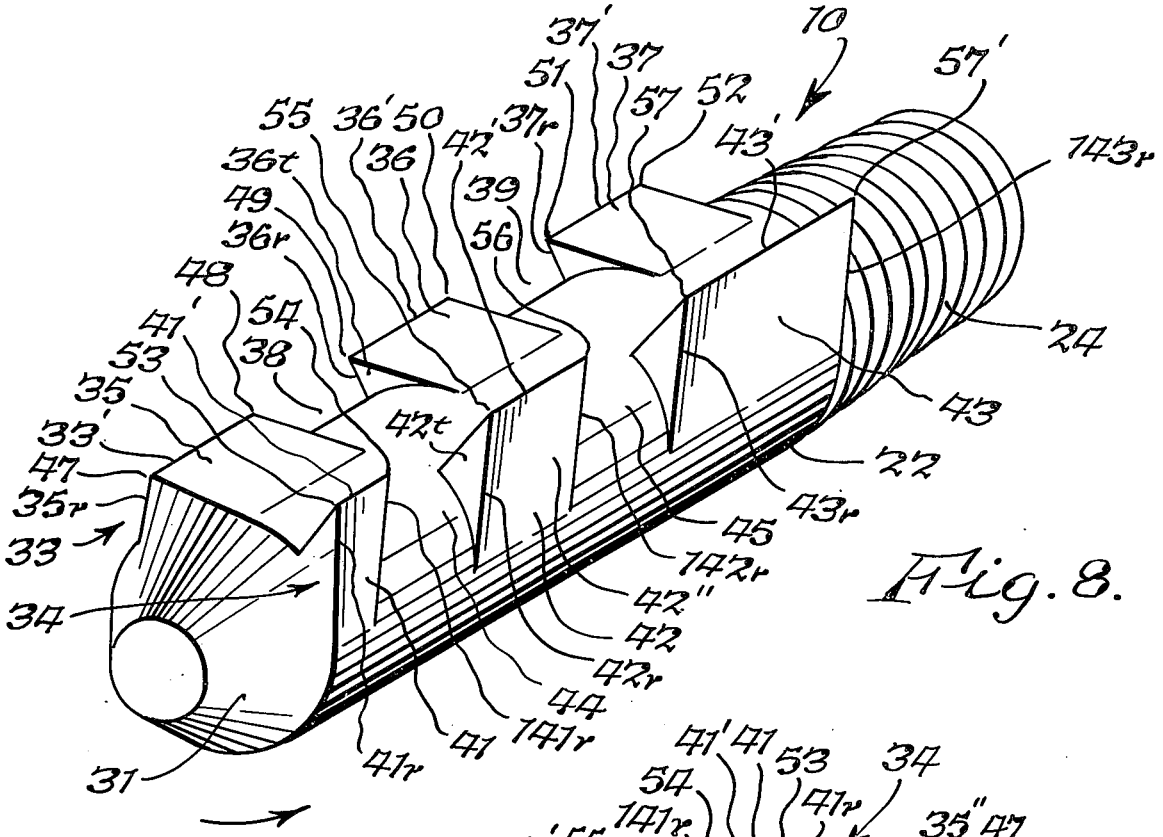
FIG. 8 is a perspective view of the lance tip from the front end and showing the rows of blades.
Figure 9:
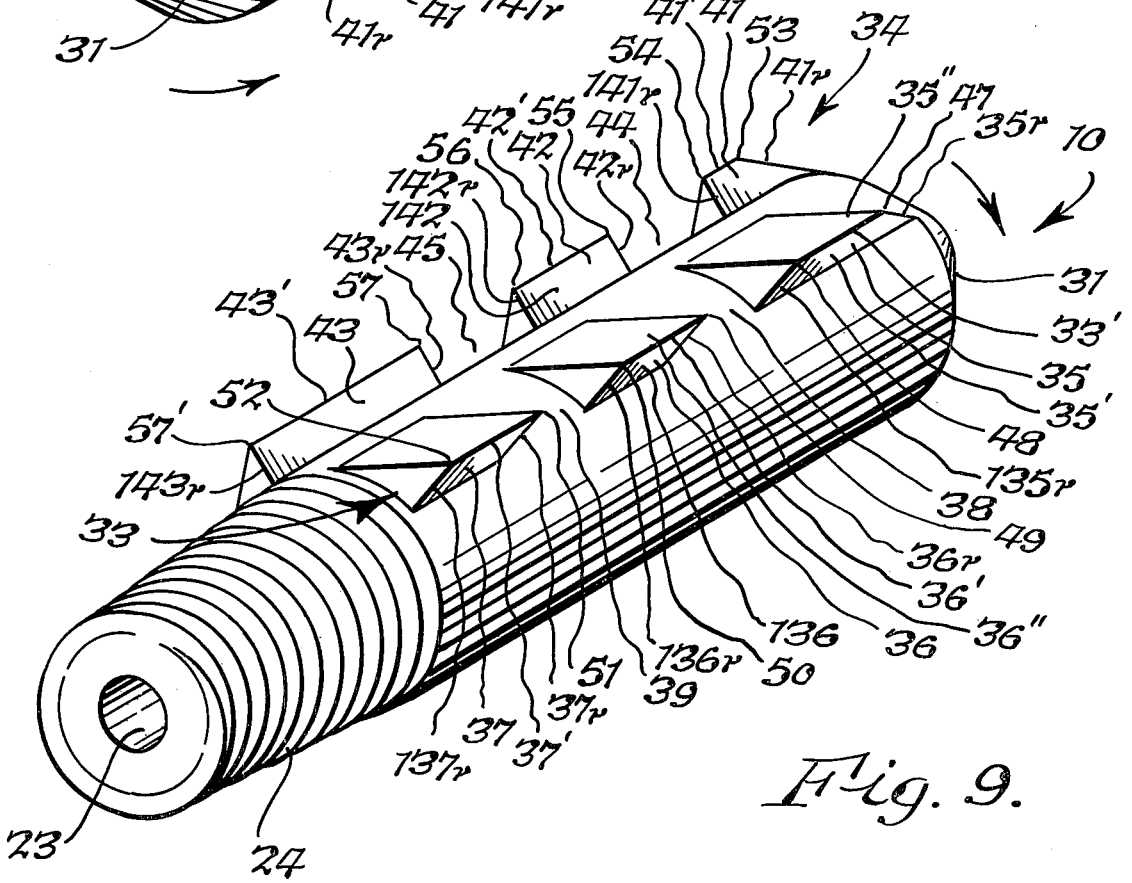
FIG. 9 is a perspective view of the lance tip from the rear and showing the rows of blades.

In addition, both ends of blades 36, 37, 42 and 43 are substantially triangular planar surfaces, and blades 35 and 41 have one triangular end. By way of example, one triangular end of blade 42 is shown at 42*t* in FIGS. 5 and 8, and one triangular end of blade 36 is shown at 36*t* in FIGS. 6 and 8. The remainder of the blades have identical triangular surfaces at both ends, except for the leading portions of blades 35 and 41. The intersection of the triangular end surfaces of each of the blades with the planar leading radial surfaces of each of the blades produces additional cutting edges at the leading edges of the blades, and such cutting edges are radial. Thus, it can be seen from FIGS. 8 and 9 that blade 35 includes radial cutting edges 35*r* and 135*r*; blade 36 includes radial cutting edges 36*r* and 136*r*; blade 37 includes radial cutting edges 37*r* and 137*r*; blade 41 includes radial cutting edges 41*r* and 141*r*; blade 42 includes radial cutting edges 42*r* and 142*r*; and blade 43 includes radial cutting edges 43*r* and 143*r*.

The combination of the foregoing radial cutting edges with all of the axial cutting edges and the various corners provides a highly efficient incrustation-removing action. In this respect, the lance tip shown in the drawings includes a total of 18 axial and radial cutting edges which attack the incrustations, and to this are added the 12 corners on the blades which further aid in the incrustation-removing action.

In FIG. 2 the lance tip 10 is shown relative to a section of tube 12. It can readily be seen that the direction of rotation of lance tip 10 is depicted by arrow 9. The blade row 34 acts somewhat as a stabilizer for preventing the lance tip from laying over excessively. In other words, blade row 34 bears against the inside surface by tube 12, and along with the reactive force produced by jets of water emanating from bores 27 on the inside of tube 12, causes blade rows 33 to attack the inside surface of conduit 12 at the proper angle. As can also be seen from FIG. 5, the angular distance between the faces of all of the blades in row 33 and the faces of the blades in row 34 is approximately 90°. It will be appreciated that any other suitable spacing may be utilized which will cause the leading blade 33 to tend to assume the desired angle with respect to tube 12 during rotation thereof.

The above enumerated axial spaces 38, 39, 44 and 45 between the blades also facilitate the free movement of material which has been removed from the inside of tube 12, thereby obviating the tendency for the blade to get clogged. In addition, the spaces tend to obviate the possibility of large pieces of incrusted material being jammed by the blades against the inside of the wall with the attendant possibility of scoring of the wall by such material.

In FIG. 10 a modified form of the present invention is shown. In this modified form the blade portions, such as 35*a*, 36*a* and 37*a*, which are analogous to blade portions 35, 36 and 37, respectively, have rounded corner portions 47', 48', 49', 50', 51' and 52' which are analogous to corner portions 47, 48, 49, 50, 51 and 52, respectively. The rounded corners on the blade portions tend to prevent the blades from being chipped in use and further prevent any possibility of excessive scoring of the inside of tube 12 by the sharper edges of the other embodiments of the invention.

From FIG. 2 it can also be seen that the diameter of pipe 12 is a certain degree larger than the diameter of body portion 22. The reason for this is to permit one lance tip to be used with a plurality of different diameter tubes. In this respect, a lance tip having a body portion radius of ¼ inch has been used successfully with tubes having an internal radius ranging between ½ inch and ¾ inch. The fact that the radius of body portion 22 is less than the internal radius of the tube in which it is used permits it to attack the incrustations in an impacting manner, to thereby facilitate removal of such incrustations. In this respect, the various forces to which lance tip 10 is subjected result from the reactive force of the jets emanating from nozzles 27, the reactive forces resulting from the engagement of the blades with the incrustations on the inside of tube 12, the forces resulting from the rotation of lance tip 10, the forces resulting from the axial advance of lance tip 22 through tube 12, the impacting forces resulting from the whipping characteristic produced by the flexibility of lance 11 as it is rotated and advanced, and the forces resulting from chatter of the lance tip in operation. When the multi-bladed lance tip is used in the foregoing force system, extremely efficient removal of incrustations is obtained.

While the blade rows 33 and 34 have been shown as extending in an axial direction parallel to the axis of the body portion 22, it will be understood that any other suitable arrangement of the blades may be effected. In this respect, the various blades, such as 35, 36 and 37, need not extend axially in a row but may be offset circumferentially from each other to a certain extent, provided of course that they are located substantially on the opposite side of the body portion from the jet-producing bores 27. The same is true of blades 41, 42 and 43. Furthermore, it is within the scope of the present invention to use only one row of spaced blades, in which event the axial advance must be such as to avoid rifling.

It is contemplated that the water pressure which can be used is between 3,000 and 15,000 psi, the lance can be advanced between 5 and 100 feet per minute, and can be rotated between 10 and 500 rpm, but departures can be made for special situations.

While preferred embodiments of the present invention have been disclosed, it will be appreciated that the present invention is not limited thereto, but may be otherwise embodied within the scope of the following claims.

What is claimed is:

1. A tube cleaning lance tip construction for insertion into a tube comprising a body portion having a longitudinal axis and an outer surface, first bore means in said body portion for receiving high pressure fluid, second bore means in communication with said first bore means and extending through said body portion to said outer surface for causing fluid to be ejected with a net lateral force component to bias said body portion toward said tube, and a plurality of axially extending blade means with axial spaces therebetween on the opposite side of said body portion from said second bore means for engaging the inside of said tube.

2. A tube cleaning lance tip construction as set forth in claim 1 wherein said plurality of blade means are also circumferentially spaced on said body portion.

3. A tube cleaning lance tip construction as set forth in claim 2 wherein certain of said blade means are circumferentially offset from certain of said axial spaces to project circumferentially into said certain of said spaces.

4. A tube cleaning lance tip construction as set forth in claim 3 wherein said certain of said blade means completely bridge said certain of said spaces.

5. A tube cleaning lance tip construction as set forth in claim 1 wherein certain of said blade means includes at least one sharp corner.

6. A tube cleaning lance tip construction as set forth in claim 1 wherein certain of said blade means include at least two corners.

7. A tube cleaning lance tip construction as set forth in claim 1 wherein said blade means are positioned in first and second rows extending substantially parallel to the axis of said lance tip.

8. A tube cleaning lance tip construction as set forth in claim 7 wherein certain of said blade means of said first row project circumferentially into axial spaces between said blades of said second row.

9. A tube cleaning lance tip construction as set forth in claim 8 wherein certain of said blade means of said second row project circumferentially into axial spaces between said blades of said first row.

10. A tube cleaning lance tip construction as set forth in claim 1 wherein each of said blade means includes a leading surface and a trailing surface, with a cutting edge being formed by the intersection of said leading and trailing surfaces.

11. A tube cleaning lance tip construction as set forth in claim 10 wherein said leading portion extends substantially radially to said body portion, and said trailing portion extends substantially tangentially to said body portion.

12. A tube cleaning lance tip construction as set forth in claim 10 wherein certain of said blade means include a transverse surface located between said leading and trailing surfaces and intersecting therewith, and a second cutting edge being formed by the intersection of said leading surface and said transverse surface.

13. A tube cleaning lance tip construction as set forth in claim 1 wherein said blade means and said spaces are so oriented relative to each other so as to cause said blade means to project completely across all of said spaces.

14. A tube cleaning lance tip construction as set forth in claim 2 wherein said blade means which are located in a circumferentially trailing position tend to stabilize the angle at which the circumferentially leading blade means are oriented with respect to said tube.

15. A tube cleaning lance tip construction as set forth in claim 1 wherein said plurality of axially extending blade means include first cutting edges which extend axially of said body portion and second cutting edges which extend radially of said body portion.

16. A tube cleaning lance tip construction as set forth in claim 15 wherein said plurality of blade means are also circumferentially spaced on said body portion.

17. A tube cleaning lance tip construction as set forth in claim 16 wherein certain of said blade means are circumferentially offset from certain of said axial spaces to project into said certain of said spaces.

18. A tube cleaning lance tip construction as set forth in claim 15 wherein said blade means are positioned in first and second rows extending substantially parallel to the axis of said lance tip.

* * * * *